US010844698B2

(12) United States Patent
Kanstad et al.

(10) Patent No.: US 10,844,698 B2
(45) Date of Patent: Nov. 24, 2020

(54) LIQUID RETAINER FOR A PRODUCTION SYSTEM

(71) Applicant: OneSubsea IP UK Limited, London (GB)

(72) Inventors: Stig Kaare Kanstad, Fana (NO); Nils-Egil Kangas, Radal (NO); Joakim Almqvist, Radal (NO); Carl-Martin Carstensen, Nyborg (NO)

(73) Assignee: OneSubsea IP UK Limited, London (GB)

( * ) Notice: Subject to any disclaimer, the term of this patent is extended or adjusted under 35 U.S.C. 154(b) by 271 days.

(21) Appl. No.: 15/828,690

(22) Filed: Dec. 1, 2017

(65) Prior Publication Data

US 2019/0169968 A1 Jun. 6, 2019

(51) Int. Cl.

| | |
|---|---|
| ***E21B 43/12*** | (2006.01) |
| ***E21B 41/04*** | (2006.01) |
| ***E21B 43/32*** | (2006.01) |
| ***E21B 43/01*** | (2006.01) |
| ***E21B 43/36*** | (2006.01) |

(52) U.S. Cl.

CPC ..... *E21B 43/126* (2013.01); *E21B 41/04* (2013.01); *E21B 43/01* (2013.01); *E21B 43/121* (2013.01); *E21B 43/32* (2013.01); *E21B 43/36* (2013.01)

(58) Field of Classification Search

CPC ..... E21B 41/04; E21B 43/01; E21B 43/121; E21B 43/126; E21B 43/32; E21B 43/36

See application file for complete search history.

(56) References Cited

U.S. PATENT DOCUMENTS

| | | | | |
|---|---|---|---|---|
| 4,527,632 | A | 7/1985 | Chaudot | |
| 5,035,842 | A | 7/1991 | Mohn | |
| 2007/0274842 | A1* | 11/2007 | Campen | E21B 43/36 417/53 |
| 2015/0315884 | A1* | 11/2015 | Hofstad | F04D 31/00 415/1 |
| 2016/0138595 | A1* | 5/2016 | Becquin | F04D 3/00 415/1 |
| 2016/0138762 | A1* | 5/2016 | Becquin | F17D 1/065 137/1 |
| 2016/0145980 | A1* | 5/2016 | Cunningham | F04D 19/002 417/423.3 |
| 2017/0167809 | A1* | 6/2017 | Becquin | F04B 47/06 |
| 2017/0175731 | A1* | 6/2017 | Abrol | F04B 49/20 |
| 2017/0260983 | A1* | 9/2017 | Grotterud | F04D 7/04 |
| 2018/0202432 | A1* | 7/2018 | Slater | F04D 31/00 |
| 2018/0306007 | A1* | 10/2018 | Morrison | E21B 41/0007 |

FOREIGN PATENT DOCUMENTS

| | | | |
|---|---|---|---|
| EP | 2149673 | A1 | 2/2010 |
| WO | 2016077674 | A1 | 5/2016 |

OTHER PUBLICATIONS

Extended European Search Report issued in European Patent Appl. No. 18209584.4 dated Apr. 3, 2019; 10 pages.

* cited by examiner

*Primary Examiner* — James G Sayre

(74) *Attorney, Agent, or Firm* — Helene Raybaud

(57) ABSTRACT

An apparatus includes a seabed-disposed pump that includes an inlet to receive a fluid flow and an outlet. The apparatus includes a liquid retainer that is adapted to receive a fluid flow that is produced by a subsea well. The liquid retainer selectively retains and releases liquid from the fluid flow to regulate a gas volume fraction of the fluid flow that is received at the inlet of the pump.

17 Claims, 6 Drawing Sheets

LIQUID RETAINER FOR A PRODUCTION SYSTEM

BACKGROUND

A subsea production system may contain a seabed-disposed pump to communicate a production flow to a surface platform. The production flow typically contains a mixture of oil, water and gas; and the amount of gas in this mixture, characterized by a parameter called a "gas volume fraction," may vary during different phases of production. For example, during the initial startup of a well, the pump may experience a completely dead field in which no liquid is produced from the well until the gas cap has been removed. Moreover, after initial well startup, the pump may, from time to time, experience a condition in which a slug enters the pump.

The slug may be a relatively large gas bubble (called a "gas slug" herein), or the slug may be a relatively large liquid pocket (called a "liquid slug" herein). In general, a liquid slug may be an issue for wet gas compressors, and a gas slug may be an issue for multiphase and hybrid pumps. For example, a slug may cause a pump or wet compressor to trip. Moreover, the maximum differential pressure that a multiphase or hybrid pump can deliver is a function of the gas volume fraction of the flow entering the suction inlet of the pump, and a gas slug may lower this pressure.

SUMMARY

In accordance with an example implementation, an apparatus includes a seabed-disposed pump that includes an inlet to receive a fluid flow and an outlet. The apparatus includes a liquid retainer that is adapted to receive a fluid flow that is produced by a subsea well. The liquid retainer selectively retains and releases liquid from the fluid flow to regulate a gas volume fraction of the fluid flow that is received at the inlet of the pump.

In accordance with another example implementation, an apparatus includes a pump, a recirculation path and a flow splitter. The recirculation path is coupled between an inlet and an outlet of the pump. The flow splitter receives a first flow and provides a second flow to the inlet of the pump. The flow splitter includes a receptacle to a receptacle to receive the first flow and retain a predetermined volume of liquid to regulate a gas volume fraction at the inlet of the pump.

In accordance with yet another example implementation, a method that is usable with a well includes pumping production fluid from a subsea well to a surface platform. The method includes storing and releasing liquid that is associated with the communication of the production flow to regulate a gas volume fraction of the fluid flow.

Advantages and other features will become apparent from the following drawings, description and claims.

DETAILED DESCRIPTION

Figure 1:
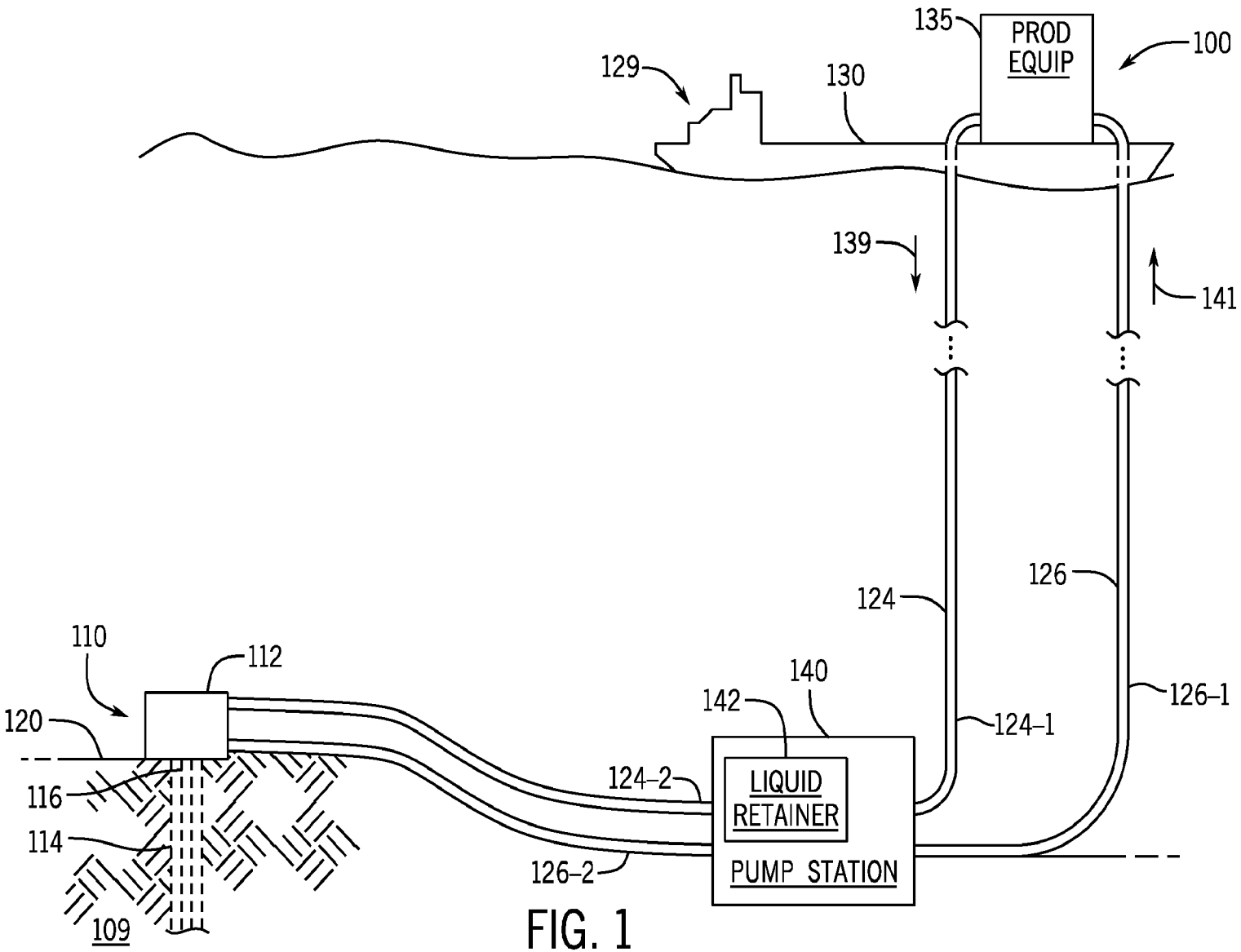
FIG. 1 is a schematic diagram of a subsea production system according to an example implementation.

In the drawings and description that follow, like parts are typically marked throughout the specification and drawings with the same reference numerals. The drawing figures are not necessarily to scale. Certain features of the disclosed implementations may be shown exaggerated in scale or in somewhat schematic form and some details of conventional elements may not be shown in the interest of clarity and conciseness. The present disclosure is susceptible to implementations of different forms. Specific implementations are described in detail and are shown in the drawings, with the understanding that the present disclosure is to be considered an exemplification of the principles of the disclosure, and is not intended to limit the disclosure to that illustrated and described herein. It is to be fully recognized that the different teachings of the implementations discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to." Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the implementations, and by referring to the accompanying drawings.

A production flow from a subsea well may be a multiphase flow; and accordingly, a production system may contain a seabed-disposed pump and a flow mixer that is disposed upstream of the pump for purposes of mixing liquid and gas present in the multiphase flow to improve the homogeneity of the flow at the inlet of the pump. The production system may also include, for example, a flow splitter that is disposed downstream of the outlet, or discharge, of the pump for purposes of separating liquid from the production flow and recirculating a relatively liquid rich stream back to the flow mixer for purposes of increasing the capacity of the system to handle the multiphase flow.

In the context of this application, a "pump" generally refers to a machine that transfers a flow and/or compresses a flow (a multiphase flow, for example). As examples, the pump may be wet gas compressor, a single phase pump, a multiphase pump, a hybrid pump, a dry gas compressor (that is used in combination with a liquid scrubber), and so forth. As such, the "pump" may susceptible to gas slugs (such as the case for a multiphase pump, for example) or liquid slugs (such as the case for a wet gas compressor, for example).

The production flow, over time, may experience relatively large variations in gas volume fractions and slug lengths, as compared to fully developed flow regimes. For example, for such cases as dead well startup in which a production from a well resumes or for severe slugging that occur during non-startup, gas bubbles, or gas slugs, that are several hundred meters long may exist in the inflow line to a subsea pump station. Such flow conditions, in turn, may, within seconds, completely fill the entire pump station with gas while liquid is drained and/or produced from the flow splitter into the downstream flow line. The operating envelope of a pump of the pump station may be highly sensitive to the gas volume fraction of the flow entering the pump's inlet; and accordingly, such operating conditions may cause unintended pump trips. These pump trips, in turn, may limit production or in the worst case, prevent any production from the field as the pump discharge pressure is insufficient to produce into the downstream flow line.

In accordance with example systems and techniques that are described herein, a subsea production system includes one or multiple liquid retainers for purposes of regulating the gas volume fraction of the flow that is provided to a pump of the system. For the case of a dead well, the liquid retainer allows the gas cap in the dead well to be mixed with liquid from one or multiple other wells, thereby allowing some liquid to enter the liquid retainer. The system may then be used to ensure that the liquid leaving the pump is delayed, which allows reusing some of the liquid to allow more time for starting up the dead well.

In accordance with example implementations, the liquid retainer, if located upstream of a pump (such as a multiphase or hybrid pump, for example), reduces the otherwise detrimental effect of a sudden large gas bubble entering the pump by releasing, or feeding out, liquid to reduce an otherwise rapid increase in the gas volume fraction at the suction inlet of the pump. Moreover, as further described herein, this delay may be further prolonged, in accordance with example implementations, by opening a choke to route part of the liquid separated from the flow by a flow splitter back to the liquid retainer.

In addition to releasing, or feeding out liquid, to accommodate gas slugs for pumps, the liquid retainer may alternatively be used to retain liquid for purposes of accommodating a liquid slug for a wet gas compressor. In this manner, in accordance with example implementations, the liquid retainer may retain liquid to reduce an otherwise rapid decrease in the gas volume fraction at the inlet of a wet gas compressor. Thus, depending on the particular implementation, the liquid retainer may retain or release liquid for purposes of regulating the gas volume fraction of fluid at the inlet of a pump.

Referring to FIG. 1, in accordance with example implementations, a subsea production system 100 may include flow lines, which extend from a seabed 120 to a surface platform 129, such as example flow lines 124 and 126. The flow lines 124 and 126 may be used for various purposes, such as, for example, communicating produced well fluid from the well 110 to the surface platform 129, communicating chemicals and service fluids to the well 110 from the sea surface platform 129, and so forth. Moreover, different flow lines may be used for production at different times. In accordance with example implementations, flow lines of the subsea production system 100, such as the flow lines 124 and 126, may be disposed inside risers (not shown) that extend from the sea surface platform 129 to the well 110.

For the example implementation depicted in FIG. 1, the sea surface platform 129 is formed by a surface vessel 130. However, the platform 129 may take on other forms, in accordance with further example implementations. As examples, the sea surface platform 129 may be a floating production system, such as a floating, storage and offloading (FSO) system or a floating, production, storage and offloading (FPSO) system. In accordance with further example implementations, the sea surface platform 129 may be a drilling vessel, a semi-submersible floating platform, a tension leg platform that is connected by mooring cables to the seabed 120, a gravity-based platform that is anchored directly to the seabed 120 by a rigid anchor, and so forth.

In accordance with example implementations, a pump station 140 of the subsea production system 100 is disposed on the seabed 120 and may be connected inline with one or multiple flow lines. For the example implementation of FIG. 1, the pump station 140 is connected inline with the flow lines 124 and 126. In this manner, as depicted in FIG. 1, for the flow line 124, a first segment 124-1 may extend between the pump station 140 and the platform 129, and another segment 124-2 of the flow line 124 may extend from the pump station 140 to a wellhead 112 of the well 110. In a similar manner, for the flow line 126, a first segment 126-1 may extend between the pump station 140 and the platform 129, and another segment 126-2 of the flow line 126 may extend from the pump station 140 to the wellhead 112. The subsea well 110, in general, may include a production string 116 that extends into a wellbore 114 to communicate a production flow from one or multiple hydrocarbon bearing geologic formations 109.

In general, the pump station 140 may include one or multiple pumps and one or multiple control valves (as further described herein) for purposes of assisting the communication of fluid between the well 110 and production equipment 135 at the platform 129. In this manner, when the subsea production system 100 is producing well fluid from the well 110, the pump station 140 may be operated to assist in communicating the well fluid through one of the flow lines, such as the flow line 126 (in direction 141 depicted in FIG. 1), to the production equipment 135. The pump station 140 may also be operated to assist in communicating fluid (injected treatment chemicals, gas used for lifting operations, and so forth) to the well 110, such as communicating fluid in direction 139 through the flow line 124, for example.

In accordance with example implementations, the pump station 140 includes one or multiple pumps. In accordance with example implementations, the pump may be a hydraulic compressor (a single phase pump, a multiple phase pump, a hybrid pump and so forth); or the pump may be wet gas compressor. As another example, the pump may be a dry gas compressor that is used in combination with a liquid scrubber that removes liquid upstream from the dry gas compressor. Various control lines (hydraulic control lines and/or electrical control lines), which are not depicted in FIG. 1, may extend from the platform 129 to the pump station 140 for purposes of controlling the pump(s) and valves of the pump station 140, as described herein.

For purposes of regulating, or controlling, a gas volume fraction of the flow pumped by the pump station 140, the subsea production system 100 includes a liquid retainer 142. In general, the liquid retainer 142 is constructed to selectively retain and release liquid from the production flow to regulate a gas volume fraction of the flow that is received at an inlet of a pump of the pump station 140. As described herein, depending on the particular application, the liquid retainer 142 may operate to maintain a relatively high gas volume fraction for the flow (for implementations in which the pump is a wet gas compressor, for example) by accommodating liquid slugs; or the liquid retainer 142 may operate to maintain a relatively low gas volume fraction for the flow (for implementations in which the pump is a multiphase pump, for example) by accommodating gas slugs.

Figure 2:
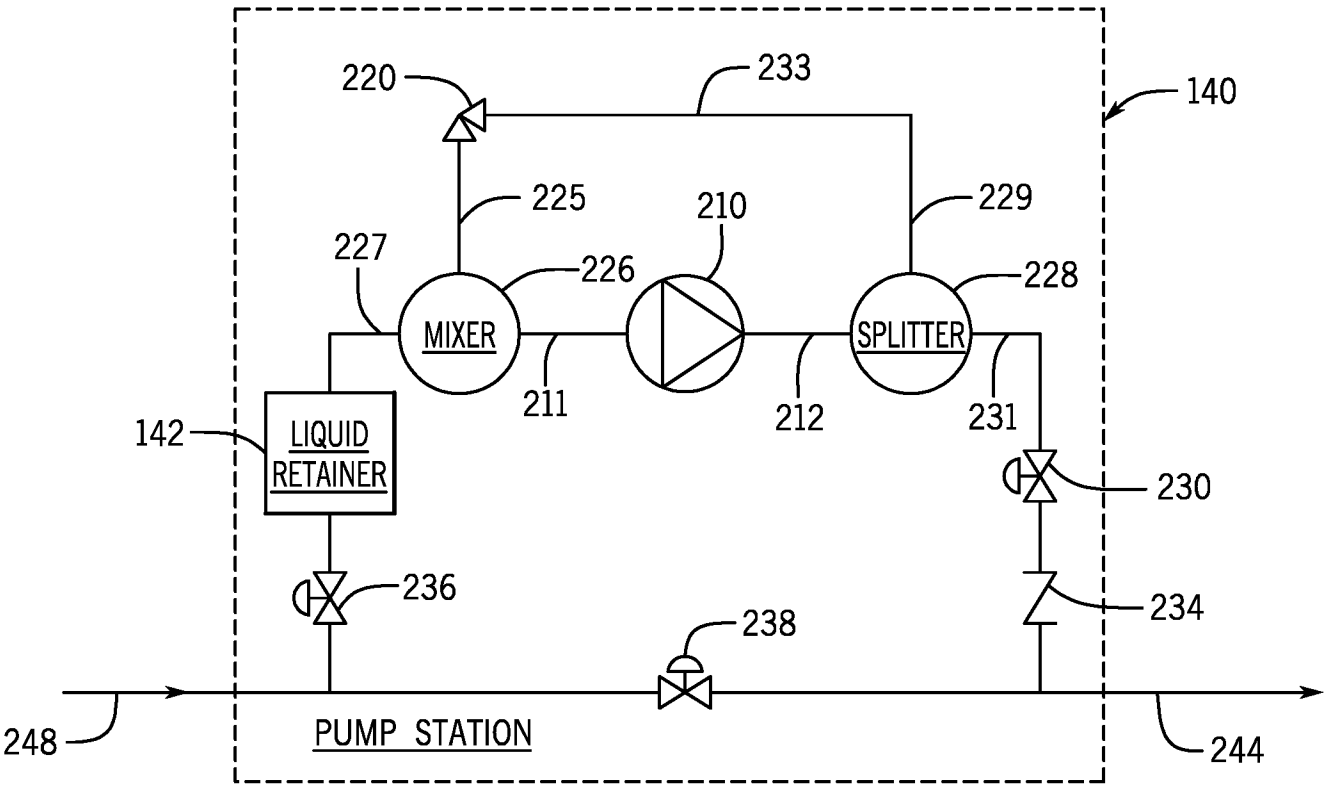
FIG. 2 is a schematic diagram of a pump station of the subsea production system of FIG. 1 according to an example implementation.

FIG. 2 depicts a schematic diagram of the pump station 140 in accordance with example implementations. In general, the pump station 140 includes at least one pump 210, and the pump station 140 has an inlet 248 and an outlet 244. The pump 210 has an associated recirculation flow path 233 that is connected between a flow splitter 228 (disposed downstream of a discharge 212 of the pump 210) and a mixer 226 (disposed upstream of a suction inlet 211 of the pump 210). In accordance with example implementations, the recirculation flow path 233, as described herein, provides a relatively liquid rich flow back to the suction inlet 211 of the pump 210. The liquid retainer 142, for the example implementation depicted in FIG. 2, is disposed between the pump station inlet 248 and an inlet 227 of the mixer 226. However, in accordance with further example implementations, the liquid retainer 142 may be located in other locations upstream of the pump's suction inlet. For example, the liquid retainer 142 may be disposed in the main flowline between the inlet and the outlet of the recirculation flow path 233.

The flow mixer 226, in general, dampens out transients upstream of the pump 210 and splits the multiphase flow equally to pumps (for implementations in which the pump station includes multiple pumps) of the pump station 140 in parallel operation. In accordance with example implementations, the flow splitter 228 extracts a liquid rich flow for the liquid rich recirculation flow path 233 to provide a minimum flow production for the pump 210. A liquid rich outlet 229 of the flow splitter 228 is connected to the recirculation path 233, and another outlet 231 of the flow splitter 228 provides the remaining flow to the outlet 244.

In accordance with example implementations, the pump may have a built-in mixer, or an upstream mixer may be present upstream of the pump/compressor to handle normal hydrodynamic slugging (a gas or liquid slug having a length that is approximately 16 to 20 times the diameter of the pipe, for example). In contrast, the flow mixer 226 and, in general, the equipment described herein, may handle relatively larger gas or liquid slugs, such as a slug that has a length that is a factor of 100 times the diameter of the pipe or longer (liquid slugs having lengths of a few tens of meters or several kilometers, as examples).

Among its other features, in accordance with some implementations, the pump station 140 may include isolation valves 236 and 230 that may be closed for purposes of isolating the pump 210 from the flow line; and the pump station 141 may include a check valve 234. Moreover, the pump station 140 may include a bypass valve 238 between the inlet 248 and outlet 244 of the pump station 140. As depicted in FIG. 2, in accordance with some implementations, the recirculation path 233 may include a recirculation choke 220, and the pump station 140 may include various chemical injection valves.

Figure 3:
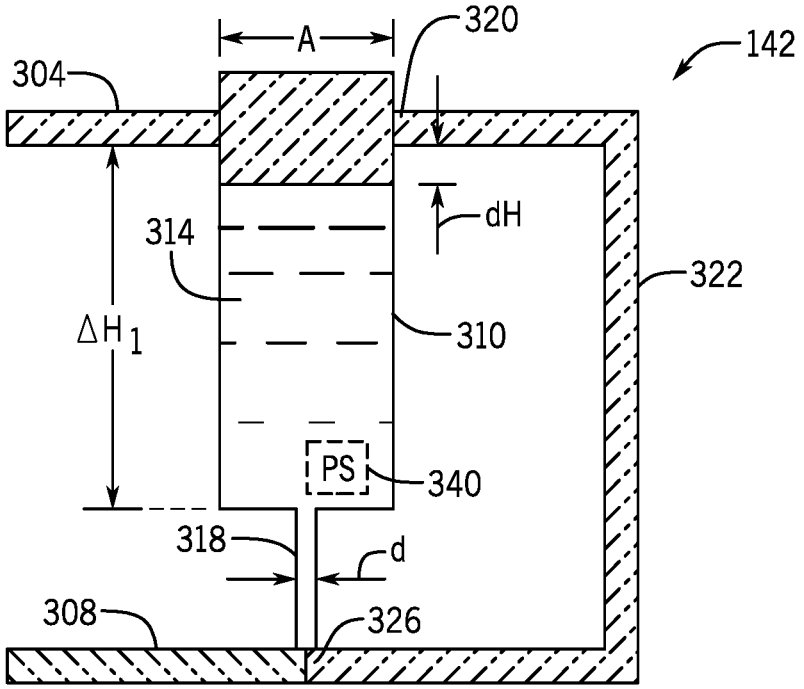
FIGS. 3, 5 and 6 are schematic diagrams of liquid retainers for the subsea production system of FIG. 1 according to example implementations.

Referring to FIG. 3 in conjunction with FIG. 2, in accordance with some implementations, the liquid retainer 142 may be disposed upstream of the flow mixer 226 (as depicted in FIG. 2) so that the multiphase flow from the inlet 248 flows through the liquid retainer 142 before continuing to the inlet 227 of the flow mixer 226. The liquid retainer 142, in accordance with example implementations, includes a tank 310, which forms a liquid reservoir 314. The tank 310 receives the incoming flow at an inlet 304.

For example implementations that are described herein, unless otherwise stated, it is assumed in the following description that the pump 210 downstream of the liquid retainer 142 is constructed to pump a flow having a relatively low gas volume fraction (such as a multiphase pump, for example), and as such, the pump 210 is susceptible to gas slugs. As such, for these implementations, when a gas slug enters the liquid retainer 142, the liquid reservoir 314 releases liquid into the outgoing flow to the pump 210 to suppress the otherwise increasing gas volume fraction at the inlet of the pump 210. It is noted, however, that in accordance with further example implementations in which the pump 210 is susceptible to liquid slugs (such as the case when the pump 210 is a wet compressor, for example), the liquid reservoir 314 retains fluid from the incoming flow to the liquid retainer 142, in the event of a liquid slug, for purposes of suppressing an otherwise decreasing gas volume fraction at the inlet of the pump 210.

As depicted in FIG. 3, in accordance with example implementations, the tank 310 stores liquid that has a height that is below an outlet 320 of the tank 310 (the height difference being represented in FIG. 3 by "dH"). The tank 310 includes another outlet, a drain 318, which is disposed at the bottom of the tank 310. In general, the cross-sectional flow area of the outlet 320 is larger than the cross-sectional flow area of the drain 318. The diameter of the drain 318, represented by "d" in FIG. 3, is selected to regulate the storage/release of the liquid 314 from the tank 310 so that the tank 310 is completely or nearly filled with liquid during normal multiphase flow into the inlet 304. In other words, during normal multiphase flow, the drain rate of the tank 310 is less than or equal to the liquid inflow to the tank 310. The "normal" multiphase flow is associated with a certain gas volume fraction such that the gas volume fraction is below a predefined level.

If, however, the gas volume fraction exceeds the level associated with the normal multiphase flow, the tank 310 begins draining liquid. For example, draining of the tank 310 may occur when a relatively large gas bubble (associated with severe gas slugging, for example) enters the pump station 140. As depicted in FIG. 3, the outlet 320 is connected in a flow path 322 that extends to a T connection 326 with the drain 318. The outlet of the T connection 326, in turn, is connected to an outlet 308 of the liquid retainer 142. Thus, liquid flowing through the drain 318 is introduced to the flow routed through the flow path 322 from the upper outlet 320 of the tank 310. The effect of this arrangement is that the liquid draining from the tank 310 mixes with produced gas in the event of a large gas bubble, thereby suppressing large increase in the gas volume fraction at the inlet of the pump 210. In other words, the liquid retainer 142 releases stored liquid for purposes of controlling the gas volume fraction. In accordance with example implementations, the gas volume fraction entering the pump 140 is thereby maintained at an acceptable level until the gas bubble passes through the pump station 140 and normal multiphase flow rates are once again received from the upstream flowline. The gas volume fraction into the pump 210 may therefore sufficiently unchanged over time to ensure that the pump 210 may deliver out into the downstream flow line, and pump trips may be avoided.

In accordance with example implementations, it may be assumed that the pressure loss in the main flow path 322 is zero for purposes of simplicity. Moreover, it may be conservatively assumed that there is no net liquid inflow from the main flow path 322 in the following equations. The liquid flow out of the tank 310 may, in accordance with example implementations, be described in terms of a liquid height $\Delta N$, a nozzle loss factor (k) and a d nozzle diameter d associated with the outlet 318. More specifically, in accordance with example implementations, the flow rate (Q)

of liquid out of the tank 310 may, given the above-described parameters, be described as follows:

$$Q = \frac{1}{4} \cdot \pi \cdot d^2 \cdot \frac{\sqrt{2 \cdot g \cdot \Delta H}}{k}. \quad \text{Eq. 1}$$

The change in liquid height dH may, for small time steps, be described as follows:

$$dH = \frac{Q \cdot dt}{A}, \quad \text{Eq. 2}$$

where "dt" represents the time step, and "A" represents the cross-sectional area of the tank 310.

In accordance with example implementations, the liquid retainer 142 may include a pressure sensor 340, or other sensor, for purposes of sensing the level, or height, of the liquid 314 in the tank 310. For a normal multiphase flow, the tank 310 is filled with the liquid 314. The dropping liquid level in the tank 310, however, is a warning that a relatively large gas bubble is entering the pump station 140. Therefore, by monitoring the height of the liquid that is stored in tank 310, control measures may be employed for purposes of detecting a gas slug and making adjustments to compensate accordingly.

Figure 8:
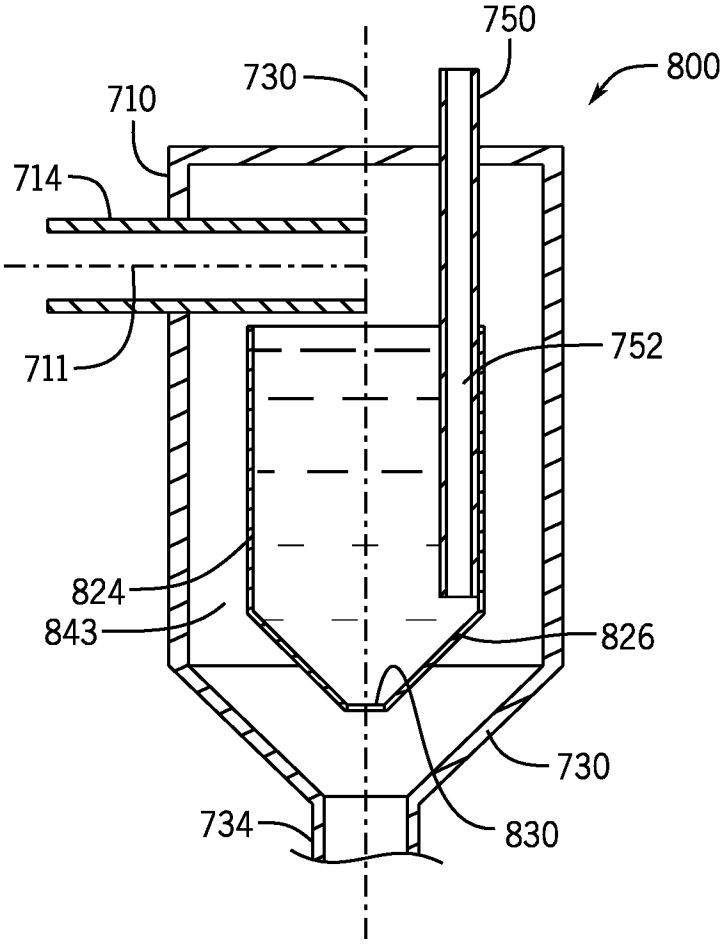
FIGS. 7 and 8 are cross-sectional views of liquid retaining flow mixers according to example implementations.
Figure 7:
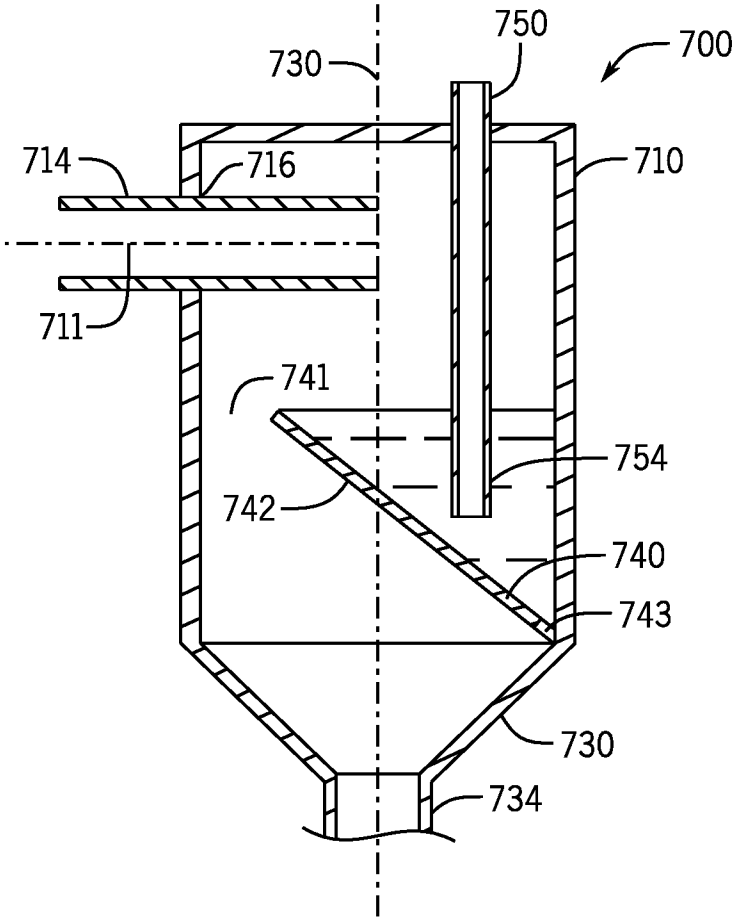

For example, in accordance with some implementations, the subsea production system may include a seabed-disposed controller (part of the pump station 140, for example), which regulates the speed of the pump 210 (slows down or speeds up, for example, according to the envelope for the pump), opens/closes a recirculation choke 220, and so forth based at least in part on the amount, or level, or fluid in tank 310. The pump speed and/or choke position may be regulated to compensate for the gas bubble if a flow splitter similar to the ones described below in connection with FIGS. 7 and 8 is used.

In accordance with further example implementations, the pressure sensor 340 may be replaced by any of a number of different types of sensors for purposes of detecting changing conditions of the liquid retainer 140 due to the presence of a deviation from the normal multiphase flow into the pump station 140.

Changing the cross-sectional flow through the choke 220 from fully closed to fully open may take several minutes, and in some field applications, this actuation time may be too slow as compared to the normal transients for the filling of the tank 310. The choke will, in such conditions, normally be more opened than required to avoid pump trips. This, however, results in an increased power consumption and reduced production from the field. A differential pressure measurement may be used in the flowline (in both ways) for purposes of allowing early detection of a slug to allow sufficient time to change the choke position to avoid pump trips.

In some cases, when the pump 210 is used to start the first well, a relatively large gas cap or large gas bubble may be produced prior to liquid being produced. The required pump differential pressure to produce out the downstream flow line may in such cases be insufficient to prevent a dead field/well startup. In such cases, in accordance with some implementations, the suction side of the pump 210 may be primed with liquid prior to pump startup to allow for the required gas volume to pass through the pump station 140. For example, in accordance with some implementations, a liquid, such as methanol (MeOH), may be used to fill up the liquid retainer 142 and station piping prior to pump startup, if introduced upstream of the pump. In a similar manner, upstream piping may also be primed. The available startup time may be further increased by continuously injecting liquid into the system upstream the liquid retainer 142 during startup to partially or fully compensate for the liquid that is "lost" into the downstream flowline.

Flowline instabilities may result in reduced production (due to increased friction loss) and more frequent stops in production. The liquid retainer 142 dampens out upstream instabilities and produces a more even flow into the downstream flowline, thereby stabilizing the entire production system with potentially increasing the overall production rates and reducing production downtime.

Figure 4:
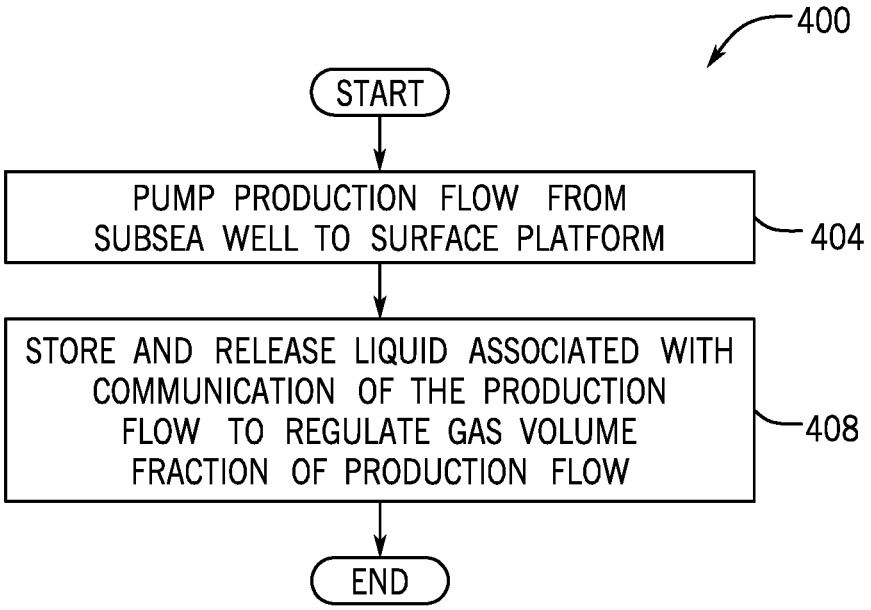
FIG. 4 is a flow diagram depicting a technique to regulate a gas volume fraction of a production flow according to an example implementation.

Referring to FIG. 4, thus, in accordance with example implementations, a technique 400 may be used to regulate a gas volume fraction of a production flow. Pursuant to the technique 400, a production flow from a subsea well is pumped (block 404) to a surface platform. The technique 400 includes storing and releasing liquid associated with the communication of the production flow to regulate a gas volume fraction of the production flow, pursuant to block 408.

In accordance with further example implementations, a liquid retainer may be formed from multiple fluid reservoirs. Depending on the particular implementations, these fluid reservoirs may either be serially connected to each other or connected to each other in parallel. For example, referring to FIG. 5, in accordance with example implementations, a liquid retainer 500 includes reservoirs that are serially connected. In general, the liquid reservoir 500 has features similar to the liquid reservoir 142 of FIG. 3, with like reference numerals being used to denote similar components. Unlike liquid retainer 142, however, the liquid retainer 500 includes a tank 510 in addition to the tank 310. The additional tank 510 has an inlet 515 that is connected to the outlet 320 of the tank 310. Moreover, for the liquid retainer 500, a drain 516 that is disposed at the bottom of the tank 510 is connected to an inlet 518 disposed near the bottom of the tank 310. Moreover, for the liquid retainer 500, the flow path 322 is replaced by a flow path 530, which extends from an upper outlet 528 of the tank 510 to the T connection 532.

For this arrangement, the drain 318 of the tank 310 has an associated diameter "$d_1$," and the drain 516 of the tank 510 has an associated "$d_2$." It is noted that in accordance with example implementations, the diameter $d_1$ is less than the diameter $d_2$. The liquid flow out of the tank 310 is determined by a static liquid height ($\Delta H_1$), while the flow of the liquid 514 from the tank 510 through the drain 516 is a function of the height difference between the fluid levels of the tanks 310 and 510, i.e., by $\Delta H_2$, as depicted in FIG. 5.

Figure 5:
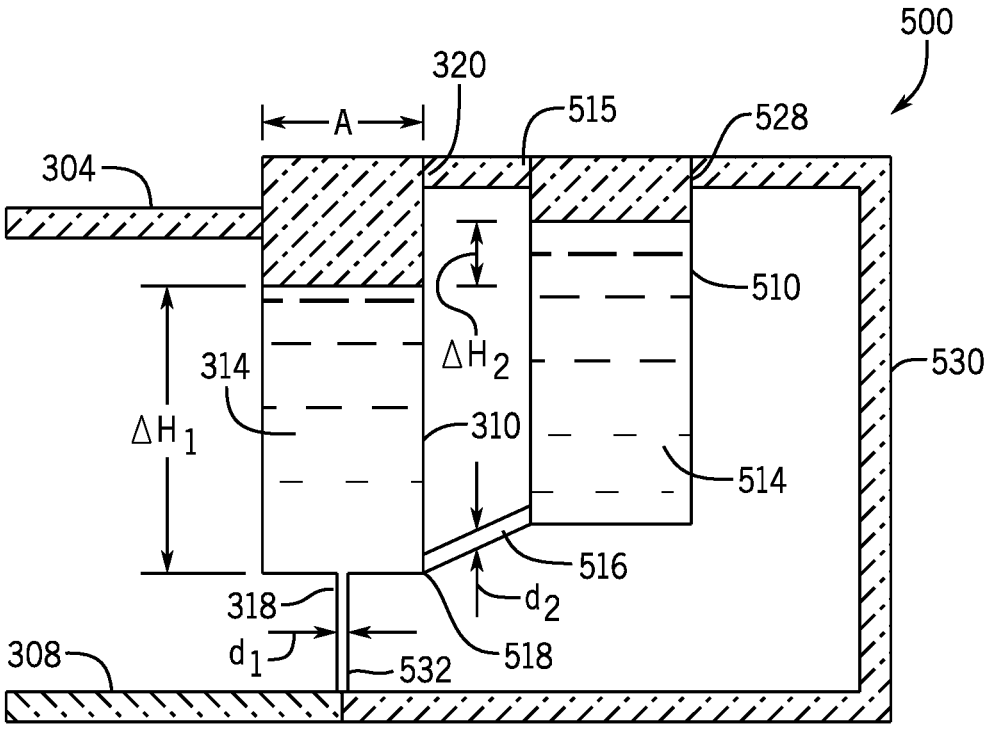

The gain from arranging the tanks in the serial connection that is depicted in FIG. 5 is that the liquid from the tank 510 begins to feed out when the liquid supplied through the outlet 320 to the tank 510 slows down. This results in a relatively or steady liquid flow rate and thereby less change in the gas volume.

The flow of liquid from the tank 310 may be described as follows:

$$Q_1 = \frac{1}{4} \cdot \pi \cdot d_1^2 \cdot \sqrt{\frac{2 \cdot g \cdot \Delta H_1}{k_1}}, \quad \text{Eq. 3}$$

where, "$d_1$" represents the diameter of the drain 318; "$\Delta H_1$" represents the liquid height of the fluid 314 stored in the tank 310; and "$k_1$" represents the nozzle loss factor associated with the drain 318.

The flow ($Q_2$) through the drain 516 of the tank 510 may be described as follows:

$$Q_1 = \frac{1}{4} \cdot \pi \cdot d_2^2 \cdot \sqrt{\frac{2 \cdot g \cdot \Delta H_2}{k_2}}, \quad \text{Eq. 4}$$

where "$d_2$" represents the diameter of the drain 516; "$\Delta H_2$" represents the height difference between the liquid levels of the tanks 510 and 310; and "$k_2$" represents the nozzle factor for the drain 516.

The height change ($DH_2$) in the tank 510 may be described as follows:

$$dH_2 = \frac{Q_2 \cdot dt}{A_2}, \quad \text{Eq. 5}$$

where "$A_2$" represents the cross-sectional area of the tank 510.

The height change ($dH_1$) in the tank 310 may be described as follows:

$$dH_1 = \frac{(Q_1 - Q_2 \cdot dt)}{A_2}. \quad \text{Eq. 6}$$

It is noted that, in accordance with example implementations, the outlet 320 of the tank 310, as well as the corresponding inlet 515 of the tank 510 is above the inlet 304 of the tank 310. This is to insure that there is always a net flow out of both tanks 310 and 510, even when both are liquid filled for purposes of avoiding various flow problems, such as sand accumulation, wax deposition, and so forth. Moreover, in accordance with example implementations, the drain 516 is inclined, or angled, as depicted in FIG. 5, for purposes of that any sand or debris in tank 510 is transported to the tank 310. Moreover, in accordance with example implementations, the tanks 310 and 510 may have conical-shaped bottoms for purposes of avoiding the accumulation of sand and debris.

In accordance with further example implementations, the outlets 320 and 528 for the tanks 310 and 510, respectively, may have vortex breakers for purposes of avoiding gas breakthrough for lower liquid levels. It is further noted that if the effective cross-sectional flow area of the drain 516 is much larger than the cross-sectional flow area of the drain 318, then the liquid retainer 500 may behave as if it contained a single tank having an effective larger cross-sectional area.

It is noted that although the liquid retainer 500 is depicted in FIG. 5 as containing two serially connected tanks 310 and 510, in accordance with further example implementations, a liquid retainer may contain more than three serially connected tanks. For example, the liquid retainer 500 in FIG. 5 may contain another tank that has its drain connected to the tank 510; and, moreover, the outlet 528 of the tank 510 may be higher in position and connected to the inlet of this other tank. Thus, many variations are contemplated, which are within the scope of the appended claims.

Figure 6:
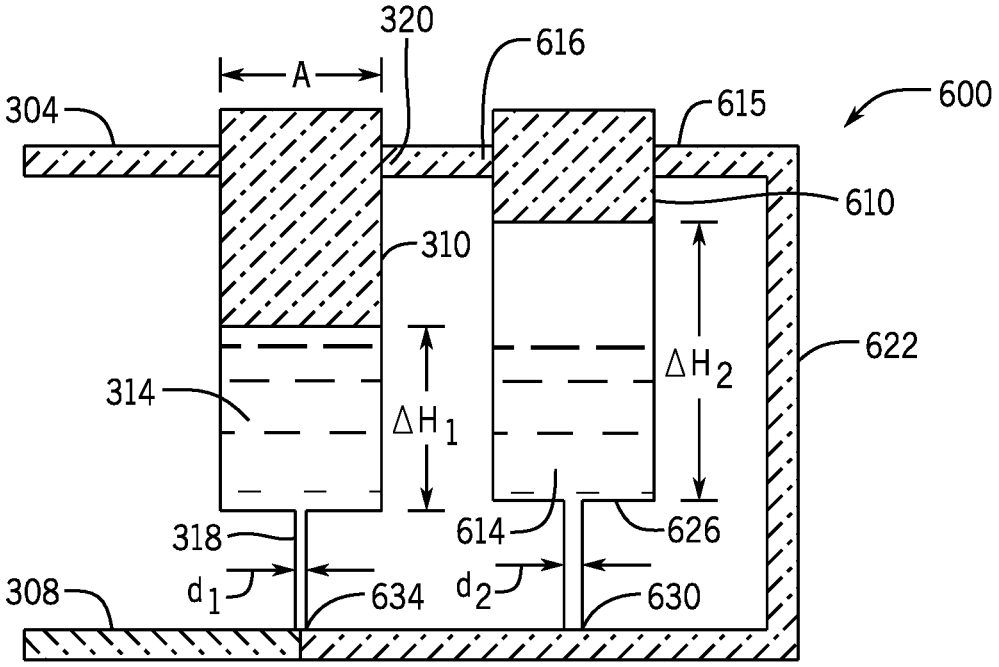

FIG. 6 depicts a liquid retainer 600 that is formed from two tanks 310 and 610, which are connected in series. The liquid retainer 600 is depicted as having components similar to the liquid retainer 300 of FIG. 3, with similar reference numerals being used. Different components are denoted by different reference numerals. The outlet 320 of the tank 310 is connected to the inlet 616 of the second tank 610. Moreover, an outlet 615 of the tank 610 is connected to a flow path 622 that is connected to a drain 626 of the tank 610 at a T connection 630. The outlet of the T connection 630, in turn, is connected to a T connection 634 but also is connected to the drain 318. The outlet of the T connection 634, in turn, is connected to the outlet 308.

In accordance with further example implementations, the tanks 310 and 610 may be connected in parallel (i.e., the incoming flow is split between the tank inlets). Such an arrangement may be beneficial for accommodating a relatively large cross-sectional area for the flow using standard piping. In accordance with example implementations, the liquid retainers may be made from standard pipe components. The discharge nozzles may be formed by orifice plates and be clamped between the tank liquid outlet flange and the pipe flange.

Referring back to FIG. 2, in accordance with some implementations, the flow splitter 228 of the pump station 140 may be replaced by a liquid retaining flow splitter 700 (FIG. 7), which is designed to avoid sand and debris accumulation while avoiding unnecessary pressure losses.

Referring to FIG. 7, the flow splitter 700 includes a housing 710 that circumscribes a vertical axis 730 and an inlet 714 that, in general, circumscribes a horizontal axis 711. The flow splitter 700 includes a catch basin, or receptacle 742, to receive the incoming flow communicated through the inlet 714. In this manner, in accordance with some implementations, the receptacle 742 is formed from a slanted wall 740 (inclined with respect to the vertical axis 730), which in conjunction with a vertical wall of the housing 710 forms the receptacle 742. The receptacle 742, in general, accumulates liquid that flows from the inlet 714. The accumulated liquid, in turn, spills as overflow into a region 741 of the housing 710 and exits an outlet 734 (surrounding the vertical axis 730) of the housing 710. Moreover, as depicted in FIG. 7, an opening 743 may be disposed at the bottom of the receptacle 742 for purposes of allowing sand and debris to leave the receptacle and flow to the outlet 734. A recirculation line 750, in accordance with example implementations, extends into the receptacle 742 such that a lower end 754 of the recirculation line 750 receives liquid from the receptacle 742 to return the liquid to the recirculation path 233 (FIG. 2) of the pump station 140.

Thus, the flow into the recirculation line 750 is liquid as long as there is sufficient liquid in the incoming flow to avoid draining the flow splitter 700 completely. This further ensures that the gas volume fraction is reduced when using the recirculation line as a minimum flow protector and consequently, improves the pump and system performance. The flow splitter 700 also increases dead field/well startup capacity (for a limited time if no fresh liquid flow into the system), as most of the liquid is recirculated while the produced gas and some of the liquid is reduced into the downstream flow line.

FIG. 8 depicts a liquid retaining flow splitter 800 in accordance with further example implementations. In general, the flow splitter 800 shares similar components with the flow splitter 700, with similar reference numerals being used to denote the similar components. Unlike the flow splitter 700, however, the flow splitter 800 includes a cylindrical receptacle 824 that circumscribes the axis 730 and catches incoming liquid from the inlet 714. As depicted in FIG. 8, a lower end 752 of the recirculation line 750 extends into the receptacle 824. Moreover, the receptacle 824 has a conical-shaped outlet 826, along with a sand and debris drain 830, for purposes of allowing accumulated sand and debris to fall to the outlet 734. An annulus 843 of the flow splitter 800 serves as a bypass outside of the receptacle 824 and is in fluid communication with the outlet 734. In accordance with example implementations, the flow out of the liquid retainers that are described herein (i.e., the liquid retainer 142, 500 and 600 as well as flow splitters 700 and 800) should preferably be restricted when the system is operating normally (i.e., no large gas bubbles) in order to enhance liquid accumulation. The flow out of the liquid retainer should, on the other hand, preferably be unrestricted when a large gas bubble arrives.

It is noted that in accordance with further example implementations, the flow splitter 700 (FIG. 7) or 800 (FIG. 8) may be used in place of the liquid retainer 142 for purposes of achieving a more compact station design. In this manner, the flow path 322 for these example implementations is the flow path around the inner liquid containing vessel. The inner liquid containing vessel may be made of relatively thin sheet, as the vessel is not a pressure containing vessel, thereby resulting in a number of advantages, such as a reduction in costs, a reduction in the number of welds, and so forth.

In accordance with example implementations, the liquid container may contain an outlet nozzle, which is constructed to have a relatively higher restriction to flow at a low produced gas volume fraction and a relatively lower restriction to flow at a relatively higher produced gas volume fraction. More specifically, in accordance with some implementations, the liquid retainer has a nozzle outlet that is directed towards the main flow. This arrangement allows the relatively higher dynamic pressure at a low gas volume fracture (i.e., a higher mixture density) to restrict the outflow from the liquid retainer.

Figure 9:
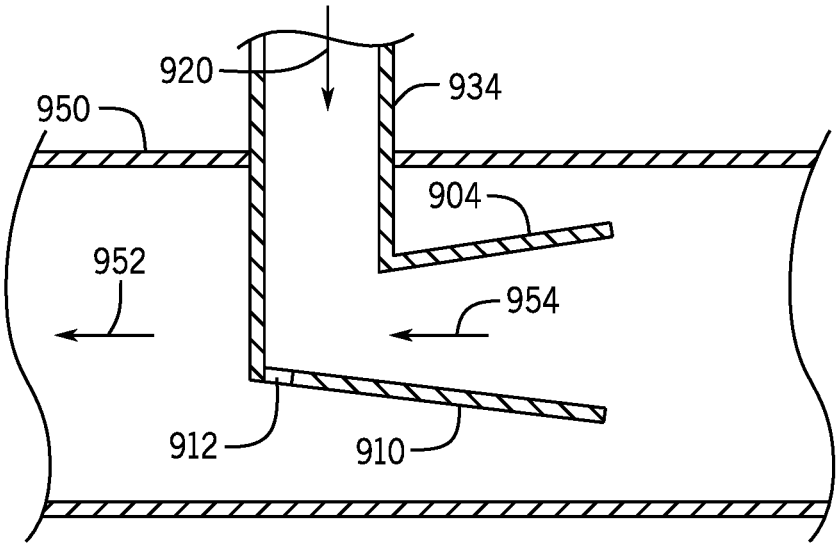
FIGS. 9 and 10 are cross-sectional views of outlet nozzles for a flow mixer according to example implementations.

More specifically, referring to FIG. 9, in accordance with some implementations, the liquid retainer may contain a nozzle 904 that receives a flow 902 from an outlet 734 and is disposed inside a main flow line 950. The nozzle 904 redirects the flow so that the flow opposes a direction 952 of the flow in the main flow line 950. Moreover, as depicted in FIG. 9, the nozzle 904 may have a conical outlet 910. In general, the dynamic pressure (called "$P_{dyn}$" below) exerted in a direction 954 may be described as follows:

$$P_{dyn}=\tfrac{1}{2}\cdot\rho\cdot v^2 \qquad \text{Eq. 7}$$

where "v" represents the flow velocity and is approximately constant; and "ρ" represents the density. Moreover, the density of a liquid may be much greater than the density of a gas, and the density of a dynamic liquid may be much greater than the density of a dynamic gas.

As depicted in FIG. 9, the nozzle that 904 may have is a drain 912 for purposes of allowing sand and debris from the outlet 734 to flow into the main flow line 950.

Figure 10:
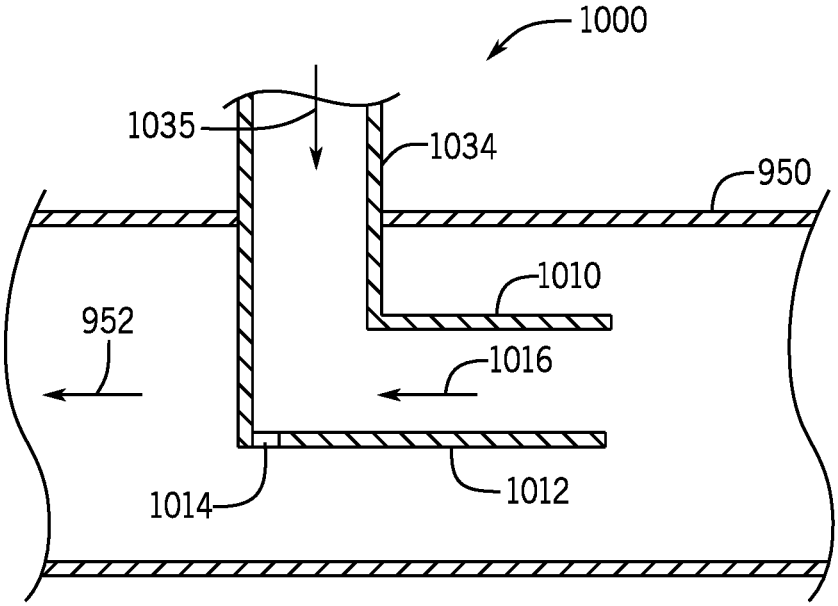

FIG. 10 depicts an outlet nozzle 1000 for a liquid retainer in accordance with further example limitations. In general, the nozzle 1000 has a similar design to the nozzle 904 of FIG. 9, with like reference numerals being used to denote similar components (outlet 1012, drain 1014, direction 1016, outlet 1034, and direction 1035). However, unlike the nozzle 904, the nozzle 1000 has a cylindrical outlet 1010 (instead of a conical outlet 910). Thus, many variations are contemplated, which are within the scope of the appended claims.

Other variations are contemplated, which are within the scope of the appended claims. For example, in accordance with further example implementations, a recirculation flow path may be included in the liquid retainer 142 of FIG. 3. In this manner, the liquid retaining flow splitters 700 (FIG. 7) and 800 (FIG. 8) are different mechanical arrangements of liquid retainers. The bypass outlet 320 of the liquid retainer 142 of FIG. 2 is a separate pipe leaving the tank 310. For the flow splitter 700 of FIG. 7 (as an example), the bypass is formed outside of a receptacle 742; and for a flow splitter 800 of FIG. 8 (as another example), the bypass is formed from an annulus outside of an inner tank receptacle 824. Using FIG. 8 as an example, a main difference between the flow splitter 142 of FIG. 3 and the flow splitter 800 of FIG. 8 is that the flow splitter 800 includes an additional flow path out of the inner tank (i.e., recirculation line 750), which is used to extract a liquid rich fluid for recirculation. It is noted that in accordance with further example implementations, this additional flow path may be included in the liquid retainer 142 of FIG. 3.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus comprising:

a seabed-disposed pump comprising a pump inlet to receive a fluid flow and a pump outlet;

a liquid retainer adapted to:

receive the fluid flow provided by a subsea well; and selectively retain and release liquid from the fluid flow provided by the subsea well to regulate a gas volume fraction of the fluid flow received at the pump inlet, wherein the liquid retainer is upstream from the pump; and a flow line to communicate a flow from the liquid retainer toward the pump along a first direction, wherein the liquid retainer comprises a liquid retainer outlet to provide a gas volume fraction regulated flow to the flow line, and the liquid retainer comprises a nozzle to introduce the gas volume fraction regulated flow into the flow line in a second direction that opposes the first direction.

2. The apparatus of claim 1, wherein the liquid retainer comprises:

a vessel to store a liquid reservoir;

a vessel inlet to communicate the fluid flow provided by the subsea well to the vessel;

a vessel outlet connected to the vessel above the liquid reservoir;

a drain outlet connected to the liquid reservoir; and a liquid retainer outlet to provide a gas volume fraction regulated flow to the pump, wherein the liquid retainer outlet is connected to the vessel outlet and the drain outlet.

3. The apparatus of claim 2, wherein the drain outlet has a cross-sectional flow area to supply liquid from the liquid reservoir to the liquid retainer outlet based on the gas volume fraction of the fluid flow received at the vessel inlet.

4. The apparatus of claim 1, further comprising:

a sensor to provide a signal representing an amount of liquid in the vessel; and a controller to regulate operational speed of pump in response to the signal.

5. The apparatus of claim 1, further comprising:

a recirculation fluid path connected between the pump inlet and the pump outlet of the pump, wherein the recirculation fluid path comprises a choke;

a sensor to provide a signal representing an amount of liquid in the liquid retainer; and a controller to regulate a cross-sectional flow area of the choke in response to the signal.

6. The apparatus of claim 1, wherein the liquid retainer comprises:

a first vessel to store a first liquid reservoir;

a first vessel inlet to communicate the fluid flow provided by the subsea well to the first vessel;

a first vessel outlet connected to the first vessel above the first liquid reservoir;

a first drain outlet connected to the first liquid reservoir;

a second vessel to store a second liquid reservoir;

a second vessel inlet connected to the second vessel;

a second vessel outlet connected to the second vessel above the second liquid reservoir;

a second drain outlet connected to the second vessel and connected to the first vessel above the first drain outlet to cause liquid from the second liquid reservoir to drain into the first liquid reservoir; and a liquid retainer outlet connected to the second vessel outlet and the first drain outlet to provide a flow to the pump inlet.

7. The apparatus of claim 6, wherein the first liquid reservoir has a first liquid height that is different than a second liquid height of the second liquid reservoir.

8. The apparatus of claim 7, wherein the second liquid from the second liquid reservoir drains into the first liquid reservoir at a rate based on a difference in the liquid heights.

9. The apparatus of claim 1, wherein the liquid retainer comprises:

a first vessel configured to store a first liquid reservoir;

a first vessel inlet to communicate the fluid flow provided by the subsea well to the first vessel;

a first vessel outlet connected to the first vessel above the first liquid reservoir;

a first drain outlet connected to the first liquid reservoir;

a second vessel configured to store a second liquid reservoir;

a second vessel inlet connected to the second vessel;

a second vessel outlet connected to the second vessel above the second liquid reservoir;

a second drain outlet connected to the second vessel;

a flow path connected to the second vessel outlet, the first drain outlet and the second drain outlet; and a liquid retainer outlet connected to the flow path to provide a gas volume fraction regulated flow to the pump inlet.

10. The apparatus of claim 1, wherein the liquid retainer outlet comprises an opening outside of the nozzle to communicate particulates from the liquid retainer to the flow line.

11. The apparatus of claim 1, wherein the nozzle comprises a conical nozzle or a cylindrical nozzle.

12. An apparatus comprising:

a pump comprising a pump inlet and a pump outlet;

a recirculation path coupled between the pump inlet and the pump outlet; and a flow splitter configured to receive a first flow and provide a second flow to the pump inlet of the pump, the flow splitter comprising:

a receptacle configured to receive the first flow and retain a predetermined volume of liquid to regulate a first gas volume fraction at the pump inlet.

13. The apparatus of claim 12, wherein the receptacle comprises an opening to communicate particulates in the receptacle to the recirculation path.

14. The apparatus of claim 12, wherein the receptacle is adapted to decrease a liquid volume to cause the first gas volume fraction at the pump inlet to be less than a second gas volume fraction in the first flow received by the flow splitter.

15. The apparatus of claim 12, wherein the receptacle is adapted to increase the liquid volume to cause the first gas volume fraction at the pump inlet to be greater than a second gas volume fraction in the first flow received by the flow splitter.

16. A method usable with a well, comprising:

pumping production fluid from a subsea well to a surface platform; and storing and releasing liquid associated with the production flow to regulate a gas volume fraction of a fluid flow, wherein storing and releasing the liquid comprises selectively retaining and releasing the liquid with a liquid retainer upstream from a pump; and wherein the pumping comprises:

recirculating a portion of the fluid flow between a pump outlet and a pump inlet of the pump; and controlling the portion of the fluid flow associated with the recirculation based on a fluid level in the liquid retainer.

17. The method of claim 16, further comprising: regulating an operational speed of the pump associated with the pumping based on a stored liquid level.

* * * * *